United States Patent [19]

Morris, Jr. et al.

[11] Patent Number: 4,751,831

[45] Date of Patent: Jun. 21, 1988

[54] LOCK ASSEMBLY FOR A METER HOUSING ASSEMBLY

[76] Inventors: Dewey Morris, Jr., 2668 Elmwood Ave., Kenmore, N.Y. 14217; Thomas M. Fleming, Sr., S-3978 Taylor Rd., Orchard Park, N.Y. 14127

[73] Assignee: Niagara Mohawk Power Corporation, 300 Erie Boulevard West, Syracuse, N.Y.

[21] Appl. No.: 920,670

[22] Filed: Oct. 20, 1986

[51] Int. Cl.[4] ..... B65D 55/14

[52] U.S. Cl. ..... 70/159; 70/34

[58] Field of Search ..... 70/158, 159, 160–162, 70/63, 32–34

[56] References Cited

U.S. PATENT DOCUMENTS

| | | | |
|---|---|---|---|
| 4,031,722 | 6/1977 | Michelman | 70/63 |
| 4,152,910 | 5/1979 | Swisher | 70/159 |
| 4,254,647 | 3/1981 | Finck | 70/63 |

OTHER PUBLICATIONS

The Highfield Mfg. Co. product data sheets (undated).

E. J. Brooks Company, Inc. product data sheets, Nos. 247, 253 and 255, dated Apr. 1979.

Inner-Tite Corp. product data sheets (undated).

*Primary Examiner*—Robert L. Wolfe

*Attorney, Agent, or Firm*—Lalos & Keegan

[57] ABSTRACT

A lock assembly for a meter housing asembly having a first housing panel fixedly mounted on a support member and a second housing panel mountable on the first housing panel and removable relative thereto along at least one predetermined line of travel, generally consisting of a retainer bracket having a first section detachably mounted on one of the housing panels and a second section engageable with the other of the housing panels when the first retainer bracket section is mounted on the one housing panel for restricting displacement of the second housing panel relative to the first housing panel along the predetermined line of travel in a direction tending to remove the second housing panel from the first housing panel, and means for locking the first retainer bracket section to the one housing panel when the first retainer bracket section is mounted on the one housing panel.

4 Claims, 3 Drawing Sheets

LOCK ASSEMBLY FOR A METER HOUSING ASSEMBLY

This invention relates to lock assembly and more particularly to a lock assembly adapted to be applied universally on meter housing assemblies of different conventional constructions.

In the electric utility industry, meters commonly are installed at the premises of consumers to measure the amount of electrical energy used by such consumers. Typically, such meters include a base member mountable on a wall located at the premises of a consumer, an electrical metering device mounted on the base member to which incoming and outgoing electrical service lines are connected, and a removable cover member which is mountable on the base member enclosing the connections of the electrical lead lines to the meter.

Usually, the cover member is intended to be removed only by utility company personnel for purposes of servicing the meter. So that only utility company personnel may remove the cover member to obtain access to the interior of the meter housing assembly, it has become the practice of most utilities to provide locks on such assemblies. Such locks are particularly used for preventing unauthorized persons from removing the cover members and tampering with the electrical connections to the meter device.

In a particular service area, it is not uncommon that a number of different meter housing assembly constructions are utilized, necessitating a number of different locking devices. Such a situation has resulted in an undue burden on utility company personnel involved in servicing such meters in that in making a call to the premises of a consumer, for the purpose of servicing a meter, the serviceman usually is unaware of the type of housing assembly or the type of locking device installed at such premises. Consequently, in making such calls, he is required to carry with him a number of different keys or other unlocking devices. Unless he carries all of his keys or other devices with him upon entering the premises of a consumer to service a meter, he would be required to make an additional trip back to his service vehicle to obtain the proper key or other device to allow him to gain access to the interior of the meter housing assembly at such premises. Such uncertainty as to the type of meter housing assembly to be found by a serviceman in making a call to the premises of a consumer and the necessity of either having to carry a large number of different keys or other unlocking devices or having to make additional trips back to his service vehicle to obtain a proper key or unlocking device has resulted in an inconvenient or time-consuming routine. It thus has been found to be desirable to provide a locking device for a meter housing assembly which is adapted not only to be incapable of being defeated by unauthorized personnel but which is universally applicable to meter housing assemblies of different constructions.

Accordingly, it is the principal object of the present invention to provide an improved lock assembly.

Another object of the present invention is to provide an improved lock assembly adapted for use with meter housing assemblies.

A further object of the present invention is to provide an improved lock assembly adapted for universal use on different meter housing assemblies of different constructions.

A still further object of the present invention is to provide an improved lock assembly adapted for use with a meter housing assembly having a fixed panel and a removable panel displaceable relative to the fixed panel.

Another object of the present invention is to provide an improved lock assembly for a meter housing assembly which is difficult to be defeated by unauthorized personnel.

A further object of the present invention is to provide an improved lock assembly adapted for use with a variety of meter housing assemblies of different constructions which is comparatively simple to install and remove by authorized personnel.

A still further object of the present invention is to provide an improved lock assembly adapted for use with a meter housing assembly which is simple in construction, comparatively inexpensive to manufacture and durable in service.

Other objects and advantages of the present invention will become more apparent to those persons having ordinary skill in the art to which the present invention pertains from the following description taken in conjunction with the accompanying drawings wherein.

Figure 1:
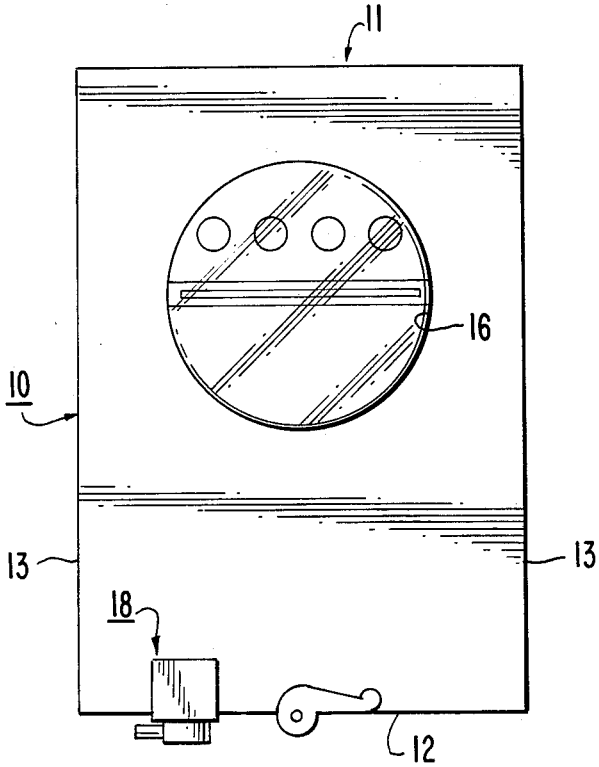
FIG. 1 is a front elevational view of a meter housing assembly having a lock assembly embodying the present invention mounted therein.
Figure 2:
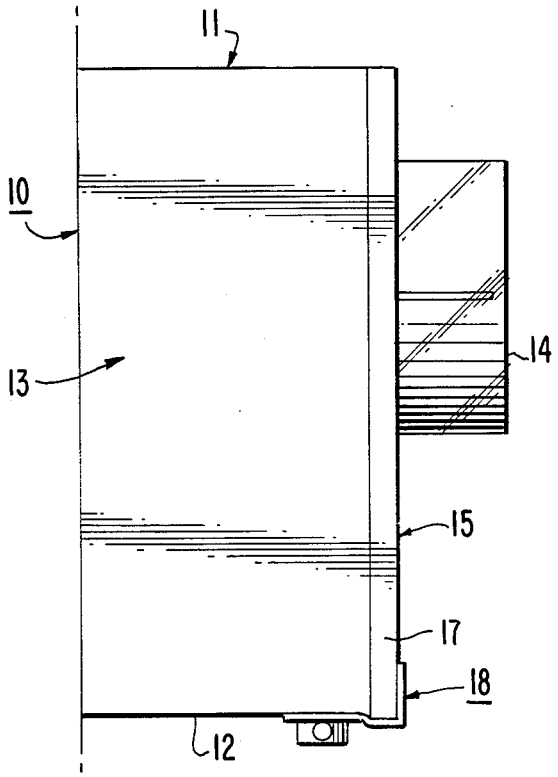
FIG. 2 is a side elevational view of the assembly shown in FIG. 1.

Referring to FIGS. 1 and 2, there is illustrated a meter housing assembly 10 adapted to be mounted on a vertical wall at the premises of an electric utility customer, generally consisting of a rear base panel adapted to be mounted on a support wall, upper and lower wall panels 11 and 12 having suitable openings for accommodating conventional electrical service wires, a pair of side walls 13,13 adjoining the rear base wall panel and the upper and lower wall panels to forrm an enclosure, and electric meter mounted within the enclosure having a forwardly protruding dial display portion 14 and a removable front wall panel 15. The removable front wall panel is provided with a circular opening 16 which is adapted to receive dial display portion 14 of the meter therethrough, and a peripheral flange 17 which is adapted to overlie the outer peripheral portions of the top, side and bottom panels of the housing when wall panel 15 is mounted on the top, bottom and side walls to complete the housing enclosure. Front wall panel 17 is prevented from being removed from the housing by means of assembly 18.

Figure 5:
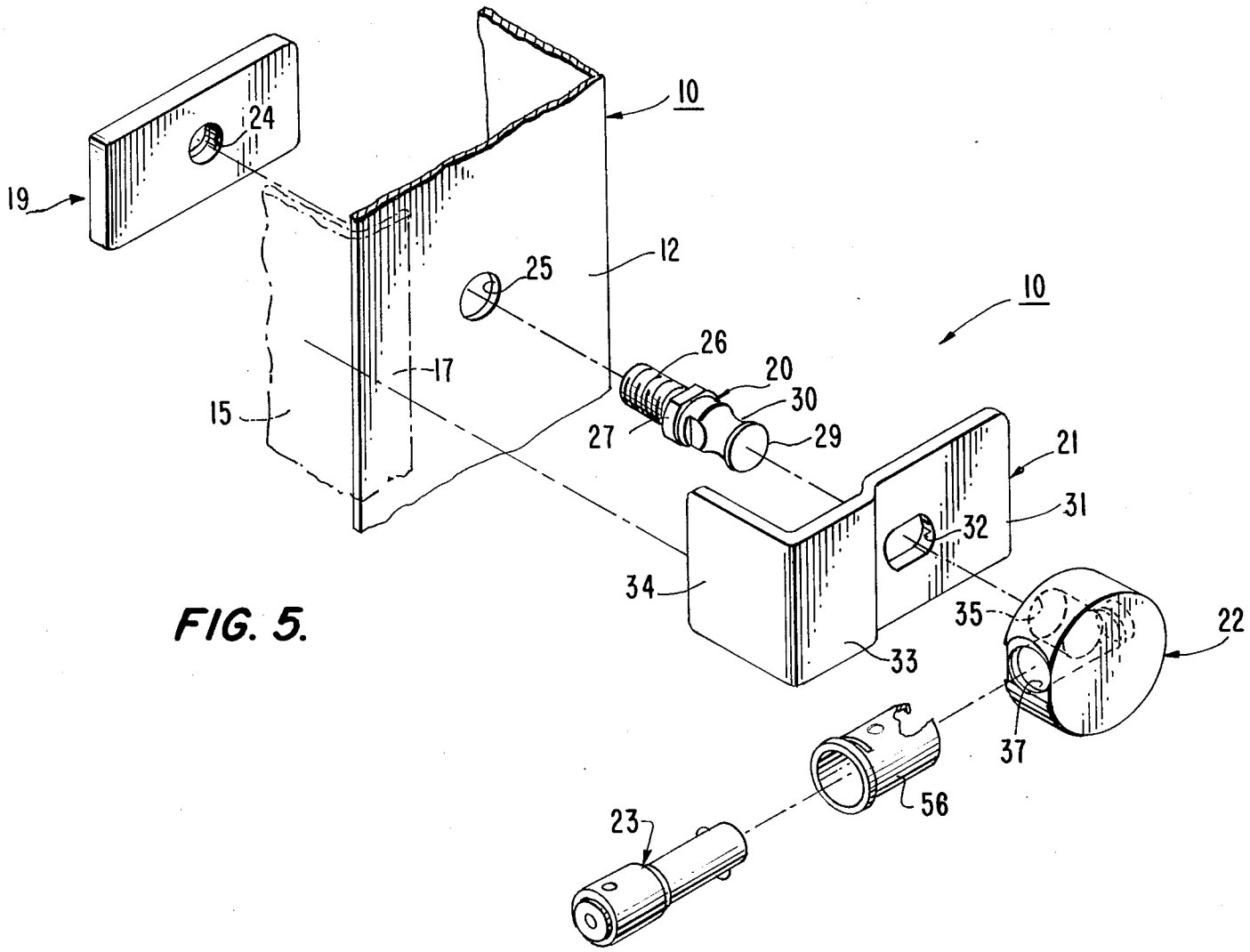
FIG. 5 is a perspective view of the lock assembly shown in FIGS. 1 through 4, illustrating the components thereof in exploded relation.

The several components of assembly 18 are best illustrated in FIG. 5. They include an anchor member 19, a stud 20, an L-shaped retainer bracket 21, a lock housing 22 and a locking member 23. The anchor member consists of a plate having a threaded opening 24 which is adapted to register with an opening 25 provided in bottom wall panel 12 of the meter housing assembly when the anchor member is positioned on the inner side of such panel. Stud 20 is provided with a threaded end portion 26 which is adapted to be inserted through opening 25 in the bottom wall panel and threaded into the anchor member to rigidly secure the stud to the bottom wall panel. The stud further is provided with a non-circular intermediate portion 27 which engages the outer surface of the bottom wall panel when the stud is mounted thereon as described, and an outer end portion 29 provided with an annular groove 30.

Retainer bracket 31 consists of a first plate section 31 having an opening 32 provided with the same cross-sectional area as the cross-sectional area of stub intermediate portion 27 and an offset portion 33, and a second section 34 disposed substantially perpendicular to plate section 31. The retainer bracket is adapted to be mounted on the meter housing assembly so taht stud 20 is received in opening 32 with intermediate stud portion 27 being disposed within opening 32, plate section 31 overlies bottom wall panel 12 and plate section 34 overlies front wall panel 15. Portion 33 of the retainer bracket is offset so that it will overlie flange 17 of front wall panel 15 when plate sections 31 and 34 engage the outer surfaces of bottom wall panel 12 and front wall panel 15, respectively.

Figure 6:
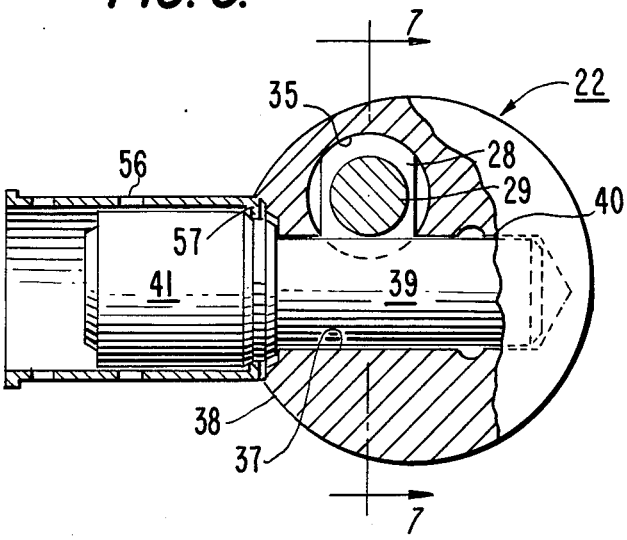
FIG. 6 is a front elevational view of the lock assembly shown in FIGS. 1 through 5, having portions thereof broken away.
Figure 7:
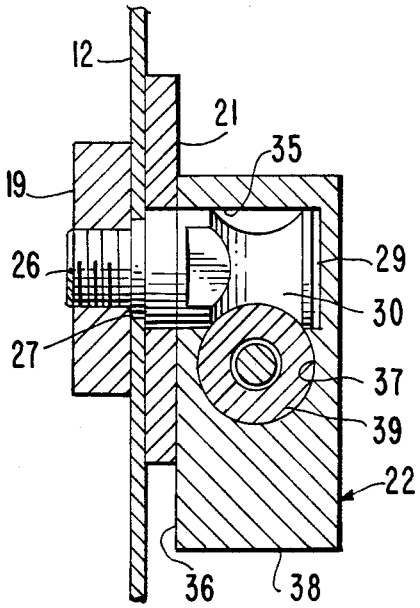
FIG. 7 is a cross-sectional view of the lock assembly taken along lines 7—7 in FIG. 6.

As best seen in FIGS. 6 and 7, lock member 22 consists of a solid piece of metal having a first bore 35 provided on a front surface 36 thereof, and a bore 37 provided in side surface 38 thereof. Bore 35 is provided with a diameter sufficient for receiving stud end portion 29 therein, and bore 37 has a diameter sufficient for receiving an end portion 39 of lock member 23. The axes of bore 35 and 37 are disposed substantially perpendicular to each other and partially intersect each other. The axes of bores 35 and 37 are spaced sufficiently apart, however, so that when stud end portion 29 is fully inserted in bore 35 and lock portion 38 is inserted in bore 37 as shown in FIGS. 6 and 7, lock portion 38 will be allowed to pass through bore 35 and a portion of annular groove 30 to lock the stud relative to the lock housing. Bore 37 also is provided with an annular, ball receiving groove 40 disposed between groove 35 and the inner end wall of bore 37.

Lock member 23 includes elongated cylindrical portion 39 which is adapted to be received in bore 37 and an enlarged head portion 41. The member is provided with an axially disposed bore 42 having an enlarged portion 43 providing a pair of opposed annular shoulders 44 and 45. Formed at the forward end of lock portion 39 is a locking ball guide bore 46 which is disposed diametrically relative to the axis of bore 42.

Figure 8:
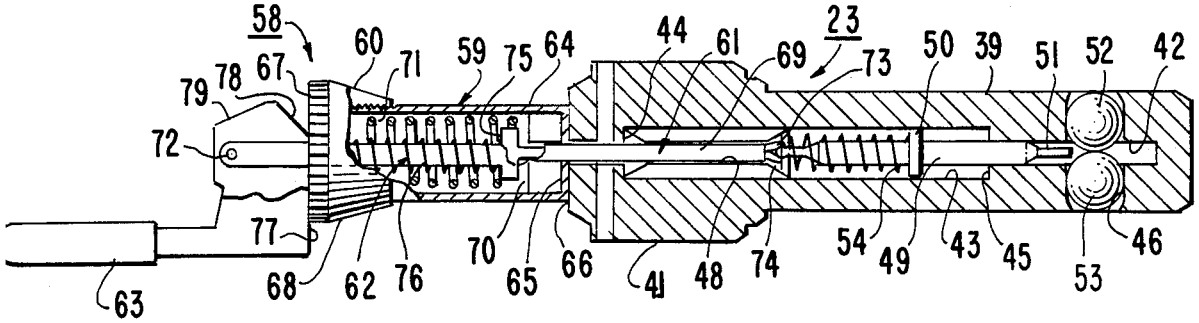
FIG. 8 is a side elevational view of a portion of the lock assembly having an unlocking key cooperating therewith and illustrating the locking member in the unlocked condition.
Figure 9:
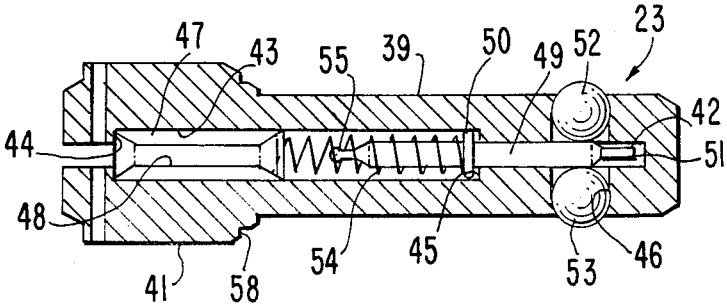
FIG. 9 is a side view of the locking member shown in FIG. 8, illustrating the member in a locking condition.

Disposed at the rearward end of enlarged bore section 43 is a spacer element 47 engaging end shoulder 41 and having an axially disposed bore 48. Disposed in bore 42 is a camming pin 49 having an annular collar 50 disposed intermediate the ends thereof and engageable with annular shoulder 45 of enlarged section 43. As best seen in FIGS. 8 and 9, camming pin 49 is provided with a camming tip portion 51 which is engageable with a pair of locking balls 52 and 53 disposed in guide bore 46 for camming such balls radially outwardly relative to the axis of the locking member when the camming pin is in its extended position with collar 50 engaging annular shoulder 45. Camming pin 49 is biased in its extended position as shown in FIG. 9 by means of a helical spring 54 interposed between an outer face of spacer element 47 and annular collar 50. The rear end of camming pin 49 is provided with a spherically shaped gripping portion 55 which is adapted to be gripped by a pair of gripping fingers of a key element inserted through bore 48 for displacing the camming pin rearwardly to permit locking balls 52 and 53 to recede radially inwardly.

When portion 39 of the lock member is inserted in bore 37 as shown in FIGS. 6 and 7, it is adapted to be provided with a ferrule 56 which fits on enlarged portion 41 of the lock member and is provided with an annular flange portion 57 which is adapted to be interposed between an annular shoulder 58 provided on enlarged lock portion 41 and a portion of the lock member about the periphery of bore 37.

Normally the components of the lock member are in the positions as illustrated in FIG. 9. To retract camming pin 49 and thus permit locking balls 52 and 53 to move radially inwardly, a key member 58, as shown in FIG. 8, is used.

Key member 58 includes a cylindrical housing 59, a cap member 60, a camming pin 61, a gripping pin 62 and an actuating handle 63. Cylindrical housing 59 includes a cylindrical wall 64 and an end wall 65 adapted to engage an end wall 66 of the lock member when the key member is inserted in the lock member. Cap 60 is provided with an end wall 67 and an internally threaded wall 68 threaded on the open end of cylindrical housing 59. Camming pin 61 includes a cylindrical portion 69 extending through an axial opening in cylindrical housing end wall 65 and insertable through bore 48 of spacer element 47 of the lock member, and an annular collar 70 disposed within cylindrical housing 59. Camming pin 61 is biased in its fully extended position by means of a helical spring 71 interposed between end 67 of cap 60 and the annular collar portion 70 of the camming pin.

Gripping pin 62 is disposed in axial alignment with camming pin 61. The outer end thereof extends through an opening in end wall 67 of cap 60 and is pivotally connected to handle 63 as at 72. The inner end of gripping pin 62 is provided with a pair of gripping fingers 73 and 74 which are connected at their outer ends to gripping pin 62, project through camming pin 61 and are adapted to encompass gripping end portion 55 of camming pin 49. Gripping pin 62 also is provided with an annular collar portion 75 which is adapted to be biased against annular portion 70 of camming pin 61 by means of a second helical spring 76 interposed between end 67 of cap 60 and annular collar 75.

Handle 63 is provided with cam surfaces 77, 78 and 79 disposed at different distances from the axis of connecting pin 72 so that when handle 63 is rotated relative to griping pin 62, the gripping pin will be displaced axially.

When key member 58 is inserted in lock member 23 and the handle of the key member is pivoted to the position as illustrated in FIG. 8, the withdrawal of gripping fingers 73 and 74 through camming pin 61 and the biasing action of spring 71 will cause the gripping fingers to engage gripping ball portion 55 and axially displace camming pin 49 outwardly to permit camming balls 52 and 53 to move radially inwardly. When handle 63 is rotated clockwise relative to FIG. 8, causing gripping pin 62 to be moved axially into the lock member, the action of camming pin 61 will be to release camming pin 49 so that the camming pin will be caused to extend under the biasing action of spring 54 to cam lockng balls 52 and 53 radially outwardly into their locking positions.

To install a locking assembly as described on a meter housing assembly 10, front wall panel 15 is first removed and the opening 25 is formed in bottom wall panel 12. With the front wall panel removed, anchor member 19 is positioned on the inner side of bottom wall panel 12 with threaded opening 24 registered with opening 23. Stud 20 is then inserted through opneing 25 and threaded into anchor member 19. With the stud then firmly secured to bottom wall panel 12, front wall panel 15 is mounted on the housing assembly to enclose the electrical connections to the meter, and retainer bracket 21 is positioned on the bottom of the housing assembly so that the outer end of the stud is received through opening 32 in the bracket, bracket section 31 overlies bottom wall panel 12 with offset portion 33 accommodating flange 17, and bracket section 34 overlies the lower end of front wall panel 15. With the bracket thus positioned, lock housing 22 is mounted on the outer end of stud 20 so that annular groove 30 registers with bore 37 in the lock housing. Lock member 23 with ferrule 56 mounted thereon and key 58 inserted therein, as shown in FIGS. 6 and 8, is then inserted in bore 37 of the lock housing, and positioned as illustrated in FIGS. 6 and 7. Handle 63 is then rotated clockwise relative to FIG. 8 to cause gripping fingers 73 and 74 to release camming pin 49. Upon the release of gripping ball portion 55 by gripping fingers 73 and 74, camming pin 49 will be caused to extend by the action of spring 54 to cam locking balls 52 and 53 radially outwardly, as shown in FIG. 9, into annular groove 40, as shown in FIG. 6. Finally, the key is removed and a seal may be inserted in the outer portion of ferrule 56 to assure that there will be no tampering with lock member 23.

With locking balls 52 and 53 cammed into the positions as shown in FIGS. 6 and 9, the lock member will be prevented from being removed from the lock housing. Correspondingly, the lock housing will be prevented form being removed from the end of the stud and the retainer bracket will prevent the removal of front wall panel 15 from the meter housing assembly.

Whenever it is desired to obtain authorized access to the interior of the meter housing assembly, the seal in ferrule 56 is removed and a key 58 with its handle rotated clockwise 180° relative to FIG. 8 is inserted in lock housing 23. The handle is then rotated counterclockwise relative to FIG. 8 to cause gripping fingers 73 and 74 to grip gripping ball portion 55 and displace it axially outwardly against the action of spring 64. With locking balls 52 and 53 thus released, lock member 23 may be removed from lock housing 22, lock housing 22 and retainer bracket 21 may be removed from stud 20 and then front wall panel 15 is free to be removed from the meter housing assembly.

Figure 3:
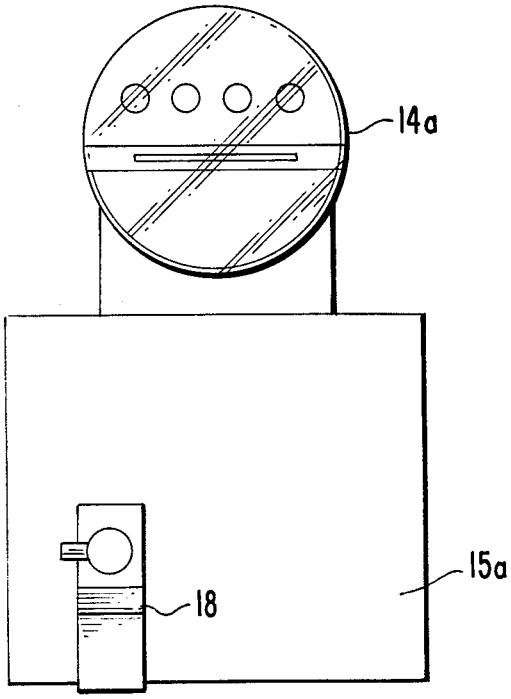
FIG. 3 is a front elevational view of another form of meter housing assembly having a lock assembly embodying the present invention mounted thereon.
Figure 4:
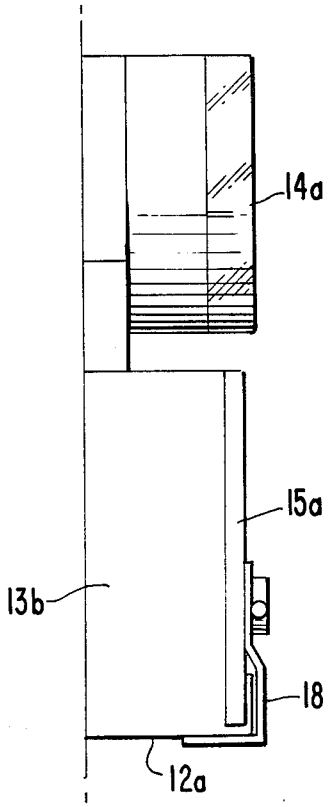
FIG. 4 is a side elevational view of the housing assembly shown in FIG. 3.

The lock assembly as described can be utilized to lock any meter housing assembly having a displaceable panel disposed perpendicularly to a fixed panel. In this respect, its application is universal in nature. In addition to being applicable to a type of meter housing assembly as shown in FIGS. 1 and 2, the assembly may be utilized in a meter housing assembly as shown in FIGS. 3 and 4 where there is provided a rear wall panel adapted to be rigidly secured to a support wall, top, bottom and side wall panels rigidly secured to the rear panel and a front wall panel which is slidable in a plane disposed substantially parallel to the rear wall panel. In such an arrangement, the stud is mounted on the slidable front wall panel **15*a* and the retainer bracket is mounted so that it overlies the front wall panel and the bottom wall panel 12*a*** as shown in the drawings. Essentially, the assembly may be used in any meter housing assembly where two adjacent wall panels are perpendicular, one of the wall panels is rigidly secured relative to the mounting wall and the other wall panel is displaceable relative to the stationary wall panel by withdrawal, pivotal or sliding action.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A lock assembly for a meter housing assembly having a first housing panel fixedly mountable on a support member and a second housing panel mountable on said first housing panel and displaceable relative thereto along a predetermined line of travel comprising:

a first retainer member mountable on an inner side of said first housing panel, said first retainer member having a stud projectable through an opening in said first housing panel when said first retainer member is mounted thereon, a second retainer member mountable on a outer side of said first housing panel, said second retainer member having an opening for receiving a free end portion of said stud therethrough when said first retainer member is mounted on the inner side of said first housing panel, said stud is projecting through the opening in said first housing panel and said second retainer member is mounted on an outer side of said first housing panel, said second retainer member having a portion thereof disposable in intersecting relation to said line of travel of the displacement of said second housing panel when said second retainer member is mounted on the outer side of said first housing panel and said stud projects through the opening therein for obstructing the displacement of said second housing panel relative to said second housing panel along said predetermined line of travel, and a mechanism removably mountable on the free end of said stud when said stud projects through the openings in said first housing panel and said second retainer member for precluding the removal of said second retainer member from said first housing panel.

2. A lock assembly according to claim 1 wherien said mechanism includes:

a housing mountable on said stud end portion in locking relation therewith, and a member for locking said housing to said stud end portion.

3. A lock assembly according to claim 2 including:

a key operatively connectable with said lock member for locking and unlocking said lock housing relative to said stud end portion.

4. A lock assembly for a meter housing assembly having a first housing panel fixedly mountable on a support member and a second housing panel mountable on said first housing panel and displaceable relative thereto along a predetermined line of travel comprising:

a first retainer member mountable on an inner side of said first housing panel, said first retainer member having a stud projectable through an opening in said first housing panel when said first retainer member is mounted thereon, a second retainer member mountable on an outer side of said first housing panel, said second retainer member having an opening for receiving a free end portion of said stud therethrough when said first retainer member is mounted on the inner side of said first housing panel, said free end portion of said stud is projecting through the opening in said first housing panel and said second retainer member is mounted on an outer side of said first housing panel, said second retainer member having a portion thereof disposable in intersecting relation with said line of travel of the displacement of said second housing panel when said second retainer member is mounted on the outer side of said first housing panel and the free end portion of said stud projects through the opening therein for obstructing the displacement of said second housing panel relative to said first housing panel along said predetermined line of travel, and a locking mechanism removably mountable on the free end of said stud when the free end of said stud projects through the openings in said first housing panel and said second retainer member to preclude the removal of said second retainer member from said housing, said locking mechanism including a lock housing provided with a first bore for receiving the free end portion of said stud therein and a second bore partially intersecting said first bore, said free end portion of said stud including an annular groove registrable with said second bore of said lock housing when said free end portion of said stud is received within said first bore, a lock member insertable in said second bore, said lock member having disengageable means for restricting the removal of said lock member from said lock housing when said stud is disposed in said first bore of said lock housing, said lock member is disposed in said second bore of said lock housing and said annular groove of the free end portion of said stud is registered with said second bore.

* * * * *